United States Patent [19]

Alvarez et al.

[11] Patent Number: 4,991,407

[45] Date of Patent: Feb. 12, 1991

[54] AUGER TYPE ICE FLAKING MACHINE WITH ENHANCED HEAT TRANSFER CAPACITY EVAPORATOR/FREEZING SECTION

[75] Inventors: Robert J. Alvarez, Denver; Tom N. Martineau, Aurora; Steven D. VanderBurgh, Boulder, all of Colo.

[73] Assignee: Mile High Equipment Company, Denver, Colo.

[21] Appl. No.: 443,019

[22] Filed: Nov. 29, 1989

Related U.S. Application Data

[63] Continuation of Ser. No. 257,770, Oct. 14, 1988, abandoned.

[51] Int. Cl.[5] ..... F25C 1/14

[52] U.S. Cl. ..... 62/354; 165/133

[58] Field of Search ..... 62/354; 165/133, 156

[56] References Cited

U.S. PATENT DOCUMENTS

| | | | |
|---|---|---|---|
| 2,279,548 | 4/1942 | Bailey | 165/133 X |
| 3,034,311 | 5/1962 | Nelson | 62/320 |
| 3,126,719 | 3/1964 | Swatsick | 62/320 |
| 3,143,865 | 8/1964 | Ross | 62/354 |
| 3,154,141 | 10/1964 | Huet | 165/133 |
| 3,165,904 | 1/1965 | Jones | 62/188 |
| 3,183,682 | 5/1965 | Conto | 62/298 |
| 3,196,628 | 7/1965 | Reynolds | 62/137 |
| 3,205,673 | 9/1965 | Soderberg | 62/71 |
| 3,283,529 | 11/1966 | Nelson | 62/320 |
| 3,372,558 | 3/1968 | Guard | 62/320 |
| 3,789,915 | 2/1974 | Ford | 165/133 X |
| 3,820,354 | 6/1974 | Kohl et al. | 62/354 |
| 3,844,134 | 10/1974 | Krueger et al. | 62/354 |
| 4,040,479 | 8/1979 | Campbell et al. | 165/133 |
| 4,429,551 | 2/1984 | Hizume | 62/354 |
| 4,467,622 | 8/1984 | Takahashi et al. | 62/354 |
| 4,660,630 | 4/1987 | Cunningham et al. | 165/133 |

*Primary Examiner*—William E. Tapolcai

*Attorney, Agent, or Firm*—Hubbard, Thurman, Turner, Tucker & Harris

[57] ABSTRACT

An auger type ice flaking machine has an evaporator section defined in part by a vertically oriented flaker barrel with closed upper and lower ends, and a knurled longitudinally intermediate exterior side surface positioned within an annular hollow jacket structure externally and coaxially mounted on the barrel and having an outlet opening positioned adjacent its upper end and communicating with the accumulator portion of an associated refrigeration circuit. Spirally wrapped tightly around the knurled surface is a coiled length of refrigerant tubing having an open lower end, and an upper end connected to the outlet of the expansion valve portion of the refrigeration circuit, adjacent coils of the tubing being longitudinally spaced apart. During operation of the machine, refrigerant is flowed downwardly through the tubing, into the jacket interior, and then upwardly through the jacket and outwardly through its outlet opening. This causes water flowed into the barrel to freeze in a thin ice layer on its interior side surface. A motor-driven auger positioned within the barrel continuously scrapes the ice layer and forces the resulting flake ice upwardly within the barrel and outwardly through a discharge opening communicating with an upper interior end portion thereof. The knurled barrel surface advantageously functions to significantly enhance the barrel-to-refrigerant heat transfer rate, thereby substantially increasing the freezing capacity of the evaporator section without the necessity of increasing its physical size.

11 Claims, 1 Drawing Sheet

AUGER TYPE ICE FLAKING MACHINE WITH ENHANCED HEAT TRANSFER CAPACITY EVAPORATOR/FREEZING SECTION

This application is a continuation of application Ser. No. 257,770, filed Oct. 14, 1988, now abandoned.

BACKGROUND OF THE INVENTION

The present invention relates generally to ice making apparatus and, in a preferred embodiment thereof, more particularly provides an auger type flake ice-making machine which is provided with a uniquely configured evaporator/freezing section that increases the freezing capacity of the evaporator without increasing its physical size.

Auger type ice flaking machines are well known in the ice manufacturing art and typically comprise an evaporator/freezing section operably interposed in a refrigeration circuit additionally including the usual compressor, condenser, expansion valve and section accumulator. In a conventional form thereof, the evaporator/freezing section has a vertically disposed cylindrical metal flaker barrel having closed upper and lower ends, and smooth outer and inner side surfaces.

During operation of the machine the refrigerant flowing through the refrigeration circuit is used to chill a longitudinally intermediate exterior side surface portion of the flaker barrel while water is being flowed into the interior of the barrel through a lower end portion thereof. The refrigerant chilling of the barrel causes the water to freeze in a thin layer around the interior side surface of the barrel. The spiralled blade of a motor-driven auger member coaxially disposed within the barrel continuously scrapes the ice layer to remove flakes therefrom which are driven upwardly within the barrel and discharged therefrom, in the form of "flake" ice, through a suitable discharge passage or chute positioned on an upper end portion of the barrel. If desired, various devices known as "pelletizers" may be incorporated into the evaporator/freezing section to convert the flaked ice into pelletized form prior to its discharge from the upper end portion of the barrel.

A particularly efficient method of chilling the exterior side surface of the flaker barrel is to tightly wind a length of refrigerant tubing around the smooth longitudinally intermediate exterior side surface portion of the barrel in a helical configuration in which the resulting tubing coils are longitudinally spaced apart from one another. The upper end of the coiled tubing is connected to the refrigeration circuit piping exiting the expansion valve, while the lower end of the tubing coil is left open. The coiled tubing section is encased within an annular jacket structure coaxially secured to and sealed around the longitudinally intermediate portion of the barrel, the jacket having an outlet opening positioned adjacent its upper end and connected to an accumulator inlet pipe portion of the refrigeration circuit.

During operation of the ice flaker, refrigerant discharged from the expansion valve is spirally flowed downwardly through the tubing coil, in a first rotational sense, and is discharged into a lower end portion of the jacket interior through the open lower end of the tubing. The refrigerant discharged from the lower tubing end in this manner is then flowed spirally upwardly through the jacket, in an opposite rotational sense, through the helical flow path defined within the jacket interior by adjacent pairs of tubing coils, and is flowed outwardly through the jacket outlet. In this manner, heat is transferred from the longitudinally intermediate barrel portion to the tubing coil and also to the refrigerant discharged therefrom into the jacket interior.

In conventional ice making machines of this type, as well as in machines employing other barrel-refrigerant heat transfer structures, there is a natural tendency for the machine's freezing capacity to diminish over time due to factors such as lime or scale buildup on the flaker barrel and/or associated water units, and dust and dirt buildups on the condenser. This natural freezing capacity reduction can eventually cause the ice making capacity of the machine to fall below its rated level. In order to compensate for this eventual capacity reduction it has heretofore been necessary to "oversize" the machine by increasing the physical size of the evaportor section—either its length, its diameter or both. This evaporator section over/sizing is, of course, undesirable since it increases the overall size, weight and cost of the ice making machine.

It is accordingly an object of the present invention to provide an ice making machine of the general type described above in which the freezing capacity of its evaporator section is substantially enhanced without the conventional necessity of increasing its physical size, or of increasing the chilling capacity of its associated refrigeration circuit.

SUMMARY OF THE INVENTION

In carrying out principles of the present invention, in accordance with a preferred embodiment thereof, the evaporator/freezing section of an auger type ice flaking machine is uniquely provided with substantially increased freezing capacity without increasing the physical size of the evaporator/freezer section or the capacity of its associated refrigeration circuit.

The improved evaporator/freezing section of the present invention includes an elongated, vertically oriented metal flaker barrel which is suitable closed at its upper and lower ends. Accordingly to a primary feature of the present invention, a longitudinally intermediate outer side surface portion of the barrel is substantially roughened—in contrast to the corresponding essentially smooth outer side surface portions in conventional flaker barrels—preferably by utilizing a mechanical knurling process thereon.

A length of refrigerant tubing is tightly wrapped around the knurled surface in a helical configuration in which the resulting tubing coils are longitudinally spaced apart from one another. The upper end of the coiled tubing is connected to the refrigeration circuit piping exiting the expansion valve, while the lower end of the tubing coil is left open. Encasing the coiled tubing section, and the knurled barrel surface around which it is tightly and spirally wrapped is an annular jacket structure coaxially secured to the barrel and sealed thereto above and below its knurled surface portion. Adjacent its upper end the jacket is provided with a refrigerant discharge opening that communicates with the inlet of the accumulator portion of the refrigeration circuit.

During operation of the ice flaking machine refrigerant flowed into the upper end of the tubing coil is forced downwardly therethrough in a spiral pattern, is discharged through the lower tubing end into the jacket interior, and is counterflowed upwardly through the jacket and outwardly through its upper discharge opening via a spiralling flow path defined between longitudinally adjacent coil pairs of the tubing. Heat transferred from the knurled barrel surface to the tubing coil, and to the refrigerant discharged therefrom and flowing upwardly through the jacket interior, causes water supplied to the barrel interior to freeze in a thin ice layer on its interior side surface. The ice layer is continuously scraped by a motor-driven auger within the barrel, the resulting flake ice being driven upwardly through the barrel interior and discharged through a suitable outlet opening communicating therewith.

The substantially roughened exterior barrel surface area formed by the knurling thereon has been found to very substantially increase the freezing capacity of the machine's evaporator section without the necessity of increasing its physical size, or of increasing the chilling capacity of its associated refrigeration circuit. This very desirable freezing capacity increase arises from several advantages provided by the knurling over its smooth surface counterparts in conventional ice flaker evaporator sections.

First, the knurling provides a more intimate and continuous contact between the tubing coil and the flaker barrel, thereby enhancing the level of barrel-to-tubing heat transfer during maching operation. Secondly, the knurling increases the effective heat transfer area of the longitudinally intermediate exterior side surface portion of the barrel while at the same time increasing its surface film heat transfer coefficient, thereby increasing the heat transfer rate directly between the barrel and the refrigerant discharged into and counterflowing through the evaporator jacket structure.

Additionally, the knurling adds turbulence to the discharged refrigerant flow to further enhance direct barrel-to-refrigerant heat transfer. Moreover, the improved and more uniform surface contact between the knurling and the coiled tubing additionally functions to significantly reduce undesirable discharged refrigerant "bypass" flow between the tubing and the exterior side surface of the barrel.

As an added bonus, the knurled barrel surface portion also facilitates the construction of the evaporator section in that it tends to inhibit unwinding of the tubing coil before is soldered or otherwise secured to the barrel.

It can easily be seen that the provision of the knurled area on the flaking barrel uniquely provides a relatively inexpensive, yet highly effective solution to the long standing problem of gradual evaporator section freezing capacity reduction without the previous necessity of increasing the physical size of the evaporator section. While knurling the outer barrel surface is a preferred method of substantially roughening it, it will readily be appreciated that such surface could be substantially roughened by alternate methods, such as shot blasting, bead blasting, etching or the like, if desired.

DETAILED DESCRIPTION

Figure 1:
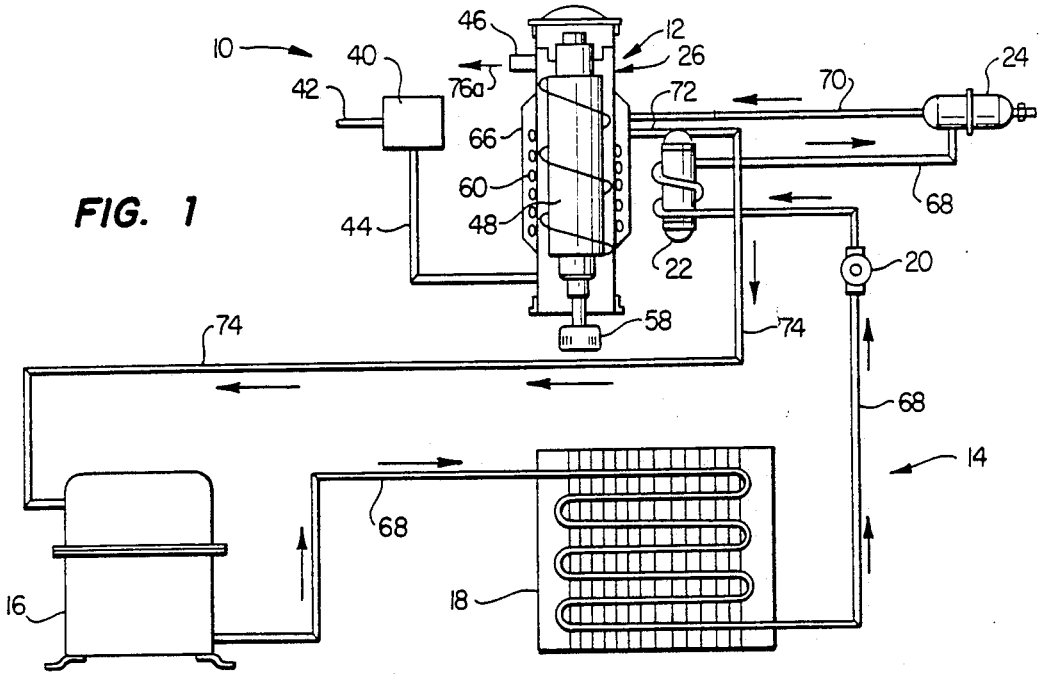
FIG. 1 is a schematic circuit diagram of an auger type ice flaking machine of the present invention.
Figure 2:
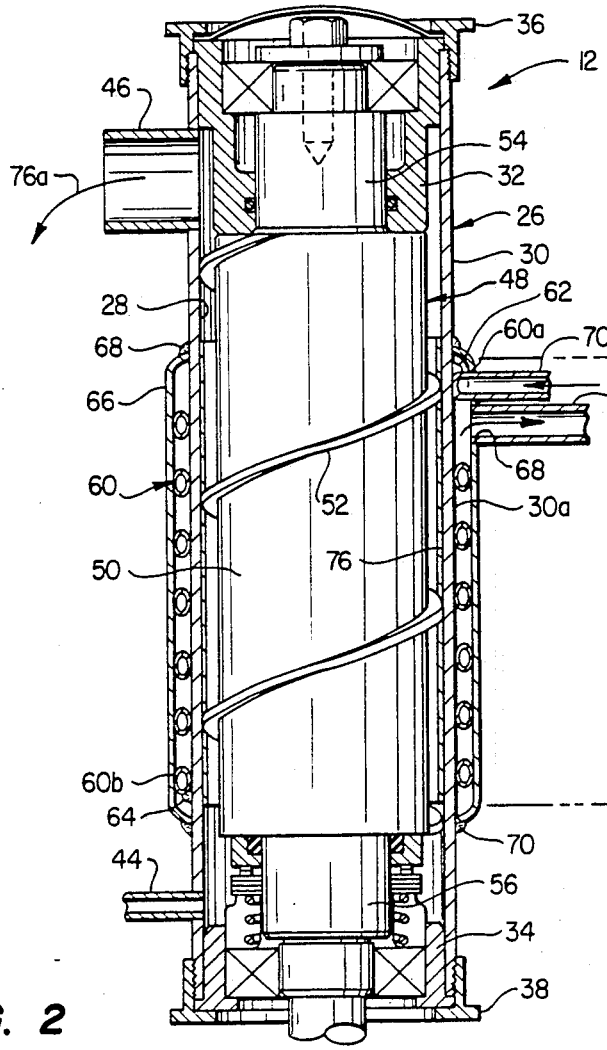
FIG. 2 is an enlarged scale cross-sectional view, partly in elevation, of the evaporator-freezing chamber portion of the circuit.
Figure 3:
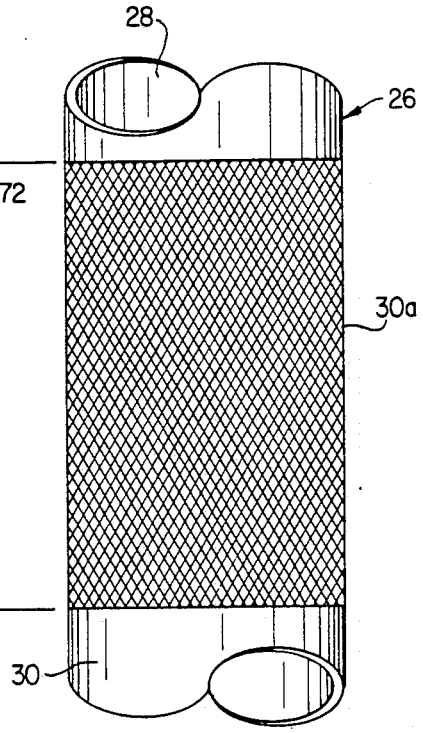
FIG. 3 is a perspective view of a longitudinally central part of the vertically disposed freezing tube portion of the evaporator, and illustrates an annular knurled exterior side surface section thereon which uniquely increases the freezing capacity of the machine without increasing the size of the evaporator section or the chilling capacity of its associated refrigeration circuit.

As illustrated in FIGS. 1-3,. the present invention provides an improved auger type ice flaking machine 10 which includes a uniquely constructed evaporator/-freezing section 12 having an associated refrigeration circuit 14 that includes a compressor 16, a condenser 18, a receiver-drier 20, an accumulator/heat exchanger 22, and an expansion valve 24. In a manner subsequently described, using principles of the present invention the freezing capacity of the evaporator section 12 is substantially increased without the necessity of increasing its physical size or increasing the chilling capacity of the associated refrigeration circuit 14.

The evaporator section 12 includes a vertically disposed metal ice flaker barrel 26 having an interior side surface 28 and an exterior side surface 30. The upper and lower ends of the barrel 26 are respectively closed by suitable bearing and seal structures 32 and 34 that are retained in place by threaded upper and lower end caps 36 and 38. A float controlled water reservoir 40 has an inlet pipe 42 for receiving water from a source thereof, and an outlet pipe 44 connected to a lower end portion of the barrel 26 for gravity feeding water thereinto. At the upper end of the barrel 26 is an ice discharge chute 46 which communicates with the interior of the barrel 26.

Coaxially disposed within the interior of the barrel 26 is a conventional ice auger member 48 having a longitudinally central body portion 50 with a helical auger blade 52 thereon, and reduced diameter upper and lower end portions 54 and 56 which are rotatably supported and sealed in the upper and lower bearing and seal structures 32 and 34. For purposes later described, the auger member 48 is rotationally driven by a motor 58 disposed externally of the barrel member 26.

Wrapped tightly around a longitudinally intermediate portion $30_a$ of the barrel member 26 is a helically coiled length of refrigerant tubing 60 having an upper inlet end $60_a$ secured to the barrel surface portion $30_a$ by solder 62, and an open lower discharge end $60_b$ which is secured to the barrel side surface portion $30_a$ with solder 64. As best illustrated in FIG. 2, the adjacent coil pairs of the tubing 60 are spaced longitudinally apart from one another along the length of the barrel member 26.

Outwardly circumscribing the coiled refrigerant tubing 60 and the annular outer side surface portion $30_a$ of the barrel member 26 is an annular hollow metal jacket structure 66 which, at its upper and lower ends, is sucured and sealed to the outer side surface of the barrel member 26 by annular solder beads 68 and 70. The jacket structure 66 bears against the outer side surface of the coils of the refrigerant tubing 60, and has an outlet opening 68 downwardly adjacent the inlet end $60_a$ of the tubing 60.

During operation of the ice making machine 10, refrigerant is discharged from the compressor 16 and flowed through the condenser 18 by a pipe 68 which flows the refrigerant through the receiver-drier 20, is wrapped around the accumulator 22, and is connected to the inlet of the expansion valve 24. Refrigerant discharged from the expansion valve 24 is flowed into the inlet end $60_a$ of the coiled tubing 60 via a pipe 70. The refrigerant delivered in this manner to the tubing 60 is flowed spirally downwardly therethrough and is discharged into the interior of the jacket structure 66 through the open outlet end $60_b$ of the tubing. The discharged refrigerant is then counterflowed upwardly through the jacket structure 66 via the spiralling flow path defined between the adjacent coil pairs of the tubing 60, the interior surface of the jacket structure 66, and the barrel member exterior side surface portion $30_a$, and is discharged from the jacket structure 66 through its upper outlet opening 68 into a pipe 72 connected to the inlet of the accumulator 22. The refrigerant is then discharged from the accumulator and flowed into the inlet of the compressor 16 via a pipe 74.

Refrigerant flow downwardly through the coiled tubing 60, and the counterflow of discharged refrigerant upwardly through the jacket structure 66 functions to chill a longitudinally intermediate portion of the barrel member 26 and form, from the water received within a lower end portion of the barrel, a thin ice layer 76 on the interior side surface 28 of the barrel member 26. Motor driven rotation of the auger member 50 causes its blade portion 52 to continuously scrape away portions of the ice layer 76 and drive them upwardly within the barrel interior for discharge through the ice chute 46 in the form of flaked ice $76_a$.

To substantially increase the freezing capacity of the evaporator section 12, without increasing its physical size or increasing the chilling capacity of the refrigeration circuit 14, the longitudinally intermediate exterior side surface portion $30_a$ of the barrel member 26 is substantially roughened by knurling it, with a conventional mechanical knurling tool, as best illustrated in FIG. 3, the knurl pitch being preferably approximately 16 threads per inch.

In developing the present invention, it has been found that this relatively simple and inexpensive modification of the barrel member 26 provides a very substantial increase in the freezing capacity of the evaporator section 26—on the order of from approximately 15 percent to approximately 20 percent—by enhancing the barrel-to-refrigerant heat transfer rate in several manners.

First, the knurled side surface area $30_a$ provides a more intimate and continuous contact between the tubing coil 60 and the barrel 26, thereby enhancing the level of barrel-to-tubing heat transfer during machine operation. Secondly, the knurling increases the effective heat transfer area of the longitudinally intermediate exterior side surface portion $30_a$ of the barrel, while at the same time increasing its surface film heat transfer coefficient, thereby increasing the heat transfer rate between the barrel and the refrigerant discharged into and counterflowing through the evaporator jacket structure.

Additionally, the knurled exterior side surface portion $30_a$ adds turbulence to the discharged refrigerant flow within the jacket structure to further enhance direct barrel-to-refrigerant heat transfer. Moreover, the improved and more uniform surface contact between the knurling and the coiled tubing additionally functions to significantly reduce undesirable discharged refrigerant "bypass" flow between the tubing and the exterior side surface of the barrel. This more effectively assures that the discharged refrigerant will flow in an upwardly spiralling counterflow path, as intended, between the adjacent coil pairs of the refrigerant tubing 60 which is wrapped tightly around the knurled area $30_a$.

Moreover, the knurled barrel portion $30_a$ also facilitates the construction of the evaporator section in that it tends to inhibit unwinding of the tubing coil 60 before it is soldered, as at points 62 and 64, or otherwise secured to the barrel during fabrication of the evaporator section 12.

From the foregoing it can be readily seen that the provision of the knurled exterior side surface area $30_a$ on the barrel 26 uniquely provides a relatively inexpensive, yet highly effective solution to the longstanding problem of gradual evaporator section freezing capacity reduction without the previous necessity of increasing the physical size of the evaporator section. While knurling the outer barrel surface is a preferred method of substantially roughening it, it will readily be appreciated that such surface could be substantially roughened by alternate methods, such as shot blasting, bead blasting, etching or the like, if desired.

The foregoing detailed description is to be clearly understood as being given by way of illustration and example only, the spirit and scope of the present invention being limited solely by the appended claims.

What is claimed is:

1. An ice making machine comprising:

an evaporator section including:

a vertically disposed flaker barrel member having an inlet opening in a lower end portion thereof for receiving water from a source thereof, an outlet opening in an upper end portion thereof for discharging ice, an interior side surface, and an exterior side surface, and chilling means, including a length of refrigerant tubing tightly wrapped around said exterior side surface in a helical configuration, for receiving a throughflow of refrigerant from a source thereof to thereby chill said flaker barrel member and responsively cause the formation, from water received within said flaker barrel member, of an ice layer around a portion of said interior side surface of said flaker barrel member;

refrigeration circuit means for operatively flowing refrigerant through said chilling means;

ice removal means for continuously removing portions of said ice layer and forcing the removed portions outwardly through said flaker barrel member outlet opening; and surface contact enhancement means for substantially increasing the heat transfer rate between said flaker barrel member and said refrigerant tubing, and for substantially inhibiting movement of said refrigerant tubing relative to said flaker barrel member, said surface contact enhancement means including:

a substantially roughened portion of said flaker barrel member exterior side surface having a spaced apart series of relatively small, laterally outwardly projecting sections which, due to the tight wrapping of the refrigerant tubing around the flaker barrel member, are pressed firmly against side surface portions of said refrigerant tubing in a manner substantially increasing the surface-to-surface contact area, and thus the heat transfer rate, between said flaker barrel member and said refrigerant tubing, and creating a substantial gripping force between said flaker barrel and said refrigerant tubing which materially inhibits movement of said refrigerant tubing relative to said flaker barrel member.

2. The ice making machine of claim 1 wherein:

said substantially roughened portion of said flaker barrel member exterior side surface is a knurled surface portion.

3. The ice making machine of claim 1 further comprising:

a float controlled water reservoir having an inlet for receiving water from a source thereof, and an outlet communicating with said barrel member inlet opening for flowing water therethrough from said water reservoir.

4. The ice making machine of claim 1 wherein:

said chilling means further include a hollow jacket structure circumscribing said length of refrigerant tubing for receiving refrigerant discharged therefrom, said jacket structure having an outlet opening for discharging the received refrigerant to said refrigeration circuit means.

5. The ice making machine of claim 4 wherein:

said length of refrigerant tubing has an open discharge end positioned within said jacket structure and spaced longitudinally from said jacket structure outlet opening along said barrel member, and said length of refrigerant tubing defines with said jacket structure and said barrel member a discharged refrigerant flow path extending helically within said jacket structure between said open discharge end of said length of refrigerant tubing and said outlet opening of said jacket structure.

6. The ice making machine of claim 1 wherein:

said ice removal means include a motor-driven auger member coaxially positioned within said barrel member.

7. An evaporator section for an anger type ice flaking machine, comprising:

an elongated barrel member having closed upper and lower ends, an interior side surface, a water inlet opening in a lower end portion of said barrel member for receiving water from a source thereof, an ice outlet opening in an upper end portion of said barrel member for discharging ice removed from a layer thereof formed on said interior side surface from water received within said barrel member, and an annular, substantially roughened exterior side surface portion positioned between said water inlet opening and said ice outlet opening, said substantially roughened exterior side surface portion having a spaced series of relatively small, laterally outwardly projecting sections;

a coiled length of refrigerant tubing, tightly wrapped around said substantially roughened exterior side surface portion of said barrel member in a helical configuration, for receiving and discharging a throughflow of refrigerant from a source thereof to chill said barrel member and thereby form on said interior side surface of said barrel, from water received in said barrel member, an ice layer, side surface portions of said refrigerant tubing being pressed into intimate gripping contact with said laterally outwardly projecting sections of said substantially roughened exterior side surface portion of said barrel member in a manner substantially increasing the surface-to-surface contact area, and thus the heat transfer rate, between said barrel member and said refrigerant tubing and, due to said gripping contact, materially inhibiting relative movement between said refrigerant tubing and said barrel member;

a hollow jacket structure secured to said barrel member and enclosing said coiled tubing length therein, said jacket structure having an outlet for discharging refrigerant received therein through said coiled tubing length; and a motor-driven auger member positioned in the interior of said barrel member and operative to scrape away portions of an ice layer formed on said interior side surface of said barrel member and to force the scraped away ice portions outwardly through said ice outlet opening.

8. The evaporator section of claim 7 wherein:

said substantially roughened exterior side surface portion is a knurled surface.

9. The evaporator section of claim 8 wherein:

said substantially roughened exterior side surface portion is a mechanically knurled surface.

10. The evaporator section of claim 8 wherein:

said knurled surface has a pitch of approximately sixteen threads per inch.

11. An ice making machine comprising:

an evaporator section including:

a vertically disposed flaker barrel member having an inlet opening in a lower end portion thereof for receiving water from a source thereof, and outlet opening in an upper end portion thereof for discharging ice, an interior side surface, and an exterior side surface, and chilling means, including a length of refrigerant tubing tightly wrapped around said exterior side surface in a helical configuration, for receiving a throughflow of refrigerant from a source thereof to thereby chill said flaker barrel member and responsively cause the formation, from water received within said flaker barrel member, of an ice layer around a portion of said interior side surface of said flaker barrel member;

refrigeration circuit means for operatively flowing refrigerant through said chilling means;

ice removal means for continuously removing portions of said ice layer and forcing the removed portions outwardly through said flaker barrel member outlet opening; and surface contact enhancement means for substantially increasing the heat transfer rate between said flaker barrel member and said refrigerant tubing, and for substantially inhibiting movement of said refrigerant tubing relative to said flaker barrel member, said surface contact enhancement means including:

a substantially roughened exterior side surface portion disposed on one of said flaker barrel member and said refrigerant tubing and having a spaced apart series of relatively small, laterally outwardly projecting sections which are pressed into intimate gripping contact with an exterior side surface portion of the other of said flaker barrel member and said refrigerant tubing and operate to substantially increase the surface-to-surface contact area, and thus the heat transfer rate, between said flaker barrel member and said refrigerant tubing and materially inhibit relative movement between said flaker barrel member and said refrigerant tubing.

* * * * *